US005127940A

United States Patent [19]

Sugiyama et al.

[11] Patent Number: 5,127,940

[45] Date of Patent: Jul. 7, 1992

[54] SELF-FLUXING PELLETS TO BE CHARGED INTO BLAST FURNACE, AND METHOD FOR PRODUCING SAME

[75] Inventors: Takeshi Sugiyama; Shoji Shirouchi, both of Hyogo; Kunihiko Tokutake, Kakogawa; Mitutoshi Isobe, Hyogo, all of Japan

[73] Assignee: Kabushiki Kaisha Kobe Seiko Sho, Kobe, Japan

[21] Appl. No.: 679,828

[22] Filed: Apr. 1, 1991

Related U.S. Application Data

[63] Continuation of Ser. No. 508,491, Apr. 12, 1990, abandoned, which is a continuation of Ser. No. 238,137, Aug. 30, 1988, abandoned.

[30] Foreign Application Priority Data

Nov. 4, 1987 [JP] Japan ..... 62-294574
Nov. 20, 1987 [JP] Japan ..... 62-294575

[51] Int. Cl.[5] ..... C21C 1/16
[52] U.S. Cl. ..... 75/327; 75/768
[58] Field of Search ..... 75/758, 759, 765, 766, 75/768, 783, 327

[56] References Cited

U.S. PATENT DOCUMENTS 4,257,806 3/1981 Fujita et al. ..... 75/5
4,326,887 4/1982 McAllister et al. ..... 75/257
4,350,523 9/1982 Taguchi et al. ..... 75/5

*Primary Examiner*—Scott Kastler
*Attorney, Agent, or Firm*—Oblon, Spivak, McClelland, Maier & Neustadt

[57] ABSTRACT

Disclosed herein is a self-fluxing pellet to be charged into blast furnace, the pellets containing open pores of diameters larger than 5 μm in an amount greater than 0.045 $cm^3/g$. Calcium.ferrite structures with a thickness of 100 μm or greater exist around pores of diameters larger than 5 μm including the open pores. The self-fluxing pellets as a whole has a $CaO/SiO_2$ value higher than 0.8. For forming the self-fluxing pellets, at least one of coarse dolomite and limestone having a particle size of 44 μm–1 mm is added as a pellet material to powdery iron ore. The green pellet formed from the resulting powdery mixture are sintered at a temperature of 1220° C.–1300° C. to have a $CaO/SiO_2$ value higher than 0.8 after sintering.

10 Claims, 9 Drawing Sheets

SELF-FLUXING PELLETS TO BE CHARGED INTO BLAST FURNACE, AND METHOD FOR PRODUCING SAME

This application is a continuation of application Ser. No. 07/508,491, filed on Apr. 12, 1990, now abandoned, which is a continuation of Ser. No. 07/238,137 filed Aug. 30, 1988, now abandoned.

BACKGROUND OF THE INVENTION

This invention relates to self-fluxing pellets with improved high temperature reducibility (hereinafter referred to simply as "reducibility" for brevity), to be charged into a blast furnace as iron material, and a method for producing such pellets.

As iron ore in a fine powdery form is difficult to charge into a blast furnace in that form, it has been the conventional practice to pelletize the powdery material and sinter the resulting green pellets to obtain self-fluxing pellets which is suitable as a blast furnace charging material. The self-fluxing pellets of this sort are required to have high reducibility to enhance the iron production efficiency.

Nevertheless, the conventional self-fluxing pellets usually have reducibility of about 75 to 80%, so that there have been strong demands for self-fluxing pellets with higher reducibility and a method for producing same.

SUMMARY OF THE INVENTION

It is a primary object of the invention to provide self-fluxing pellets which have high reducibility and involve no problem in the physical properties of the pellets themselves.

It is another object of the invention to provide a method for effectively manufacturing the self-fluxing pellets of the nature mentioned above.

The above and other objects of the invention will become apparent from the following description taken in conjunction with the accompanying drawings.

BRIEF DESCRIPTION OF THE DRAWINGS

The drawings show preferred embodiments of the invention, in which:

FIGS. 2 to 10 illustrate a first specific embodiment, of which FIGS. 2 and 3 are photographs of sectioned self-fluxing pellets, FIG. 4 is a diagram, FIG. 5 is a sectional view of a self-fluxing pellet, FIG. 6 is an enlarged sectional view of part of the pellet of FIG. 5, FIG. 7 is a view corresponding to FIG. 6 but showing a conventional counterpart, and FIGS. 8 to 10 are diagrams; and FIGS. 11 to 16 illustrate a second specific embodiment of the invention, of which FIGS. 11 and 12 are photographs of sectioned self-fluxing pellets, FIG. 13 is a diagram, FIG. 14 is a sectional view of a self-fluxing pellet, FIG. 15 is an enlarged view of part of the pellet in FIG. 14, and FIG. 16 is a view corresponding to FIG. 15 but showing a conventional counterpart.

DESCRIPTION OF PREFERRED EMBODIMENTS

Figure 1:
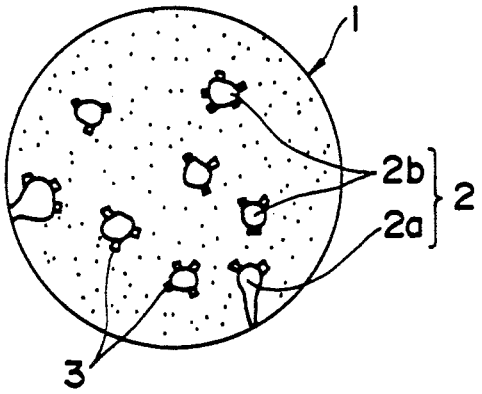
FIG. 1 is a schematic sectional view of a self-fluxing pellet.

In FIG. 1, denoted at 1 is a self-fluxing pellet according to the present invention, which is internally formed with numerous pores 2. Of these pores 2, those which are connected with the outside of the self-fluxing pellet 1 are herein called open pores **2*a* and those which are closed in the self-fluxing pellet 1 are called closed pores 2*b***.

The self-fluxing pellet 1 contains more than 0.045 $cm^3/g$ of open pores **2*a* having a diameter greater than 5 μm. The provision of this amount of open pores 2*a*** improves the reducibility to a rate higher than 80%, in contrast to the conventional pellets with reducibility lower than 75–80%.

The vein stone phase 3 of calcium.ferrite-base structures, which exists around the pores 2 of diameters greater than 5 μm, includes structures of chemical formulas such as $CaO.Fe_2O_3$ and $CaO.2Fe_2O_3$ (hemicalcium ferrite). This vein stone phase 3 is greater than 100 μm in thickness, and larger than 1.4 in the value of $CaO/SiO_2$ (basicity). In this instance, the vein stone phase 3 may have a thickness greater than 100 μm either in the entire areas or partially in the areas around the pores 2. This is because the existence of the vein stone phase 3 of a thickness greater than a certain value around the pores 2 improve the reducibility of the pellets.

Further, the self-fluxing pellet 1 is greater than 0.8 in the value of $CaO/SiO_2$ as a whole. Namely, if greater than 0.8 in that value, the reducibility improving effects by the above-defined amount of pores are increased markedly.

Furthermore, the above-mentioned self-fluxing pellet 1 is greater than 0.40 in the value of $MgO/SiO_2$ as a whole. Namely, if greater than 0.40 in that value, the reducibility is increased conspicuously. The reducibility can be improved all the more if the value of $MgO/SiO_2$ is greater than 0.47.

Described below is a method for calculating the amount of open pores **2*a*** having diameters greater than 5 μm.

Firstly, the apparent density Sa ($g/cm^3$) of the self-fluxing pellet 1 is measured by the mercury substitution method (JIS M8716). The true density S ($g/cm^3$) is measured by the pycnometer method (JIS M8717).

Nextly, from the values obtained by these measurements, the porosity P (%) is calculated as follows.

$$P = \frac{S - Sa}{S} \times 100\ (\%)$$

On the other hand, the apparent density Sc ($g/cm^3$) of the self-fluxing pellet 1 including the closed pores **2*b* is measured. The method for this measurement is same as the one employed in the measurement of the above-mentioned true density. In this case, the atmosphere surrounding the self-fluxing pellets 1 is depressurized to 0.01 mm $H_2O$, and the open pores 2*a*** are replaced with xylene to obtain the apparent density Sc.

On the basis of the values obtained by the foregoing measurements, the closed pore rate Pc (%) is calculated according to the following equation.

$$Pc = \left(\frac{S - Sc}{S}\right) \times \frac{Sa}{Sc} \times 100\ (\%)$$

Further, on the basis of the values obtained above, the volume of the open pores Vop ($cm^3/g$) is calculated according to the following equation.

$$Vop = \frac{P - Pc}{Sa} \times \frac{1}{100}$$

Nextly, the diametric distribution of the pores 2 is measured, using a mercury pressurizing type porosimeter (a product of Carlo Elva, Italy). The range of measurement is 0.074 μm–125 μm, and diameters smaller than 0.074 μm are ignored, determining the volumetric rate ($cm^3/g$) of the open pores 2a of any diameter in the above-mentioned range up to 125 μm. Namely, for instance, the volume ($cm^3/g$) of the open pores 2a in the range of 5 μm–125 μm is determined.

The measurement by the above-mentioned mercury pressurizing type porosimeter is based on the following principles. Firstly, it is assumed that the open pores 2a has a circular sectional shape with a radius r, the surface tension and the wetting angle of mercury is $\sigma$–$\theta$ reflectively and the applying pressure is P. In this case, the following equation is established when mercury is forcibly stuffed into the open pores 2a under pressure.

$$r = 2\sigma \cos \theta / P$$

Consequently, by gradually varying the pressure while making the measurement, the amount of the open pores 2a in a certain diametrical range of the pores can be determined from the amount of the stuffed mercury.

By obtaining the amount $V_{-5}$ ($cm^3/g$) of the open pores 2a smaller than 5 μm from the above-mentioned porosimeter, the initially aimed amount $V_{+5}$ ($cm^3/g$) of the open pores 2a greater than 5 μm is calculated according to the following equation.

$$V_{+5}(cm^3/g) = Vop - V_{-5}$$

On the other hand, the above-mentioned reducibility is assessed by the following method.

When the blast furnace temperature is lower than 950° C., the major portion of the charged ores are only reduced to $Fe_{1-x}O$ at most. At higher temperatures, reduction of $Fe_{1-x}O \rightarrow M.Fe$ takes place under rapidly increasing temperature condition. It is adequate to assess the reducibility by employing these reducing conditions in simplified form.

The reducing conditions include the following two steps.

Reduction for 2 hours at 900° C. (with reducing gas of $CO/CO_2 = 60/40$); and

Reduction for 2 hours at 1250° C. (with reducing gas of $CO/N_2 = 30/70$)

The reducibility is measured according to the following equation, where $W_1$ is the weight before reduction, $W_2$ is the weight after reduction at 1250° C., and T.Fe(%) and FeO(%) are values of the sample before reduction.

$$RI(1250) = \frac{W_1 - W_2}{W_1} \times \frac{1 \times 10^4}{\{0.430 \cdot (T \cdot Fe) - 0.112 \cdot (FeO)\}} (\%)$$

Although the reducibility can be suitably improved by forming the self-fluxing pellets 1 in this manner, the effects of the improved reducibility are produced more favorably by charging them into a blast furnace as described below.

Namely, when forming the self-fluxing pellets 1, a carbonaceous component is adhered to the surface of some green pellets prior to sintering. Upon sintering, a group of self-fluxing pellets stick to each other to form a block. Therefore, it becomes possible to reduce the particle size of the individual self-fluxing pellets, which also contributes to the improvement of the reducibility. When these pellets are charged into a blast furnace, they are less likely to roll around and permit to secure large rest angles. It follows that the pellets can be stacked with a predetermined angle of inclination to prevent localized gas flows.

The description is now directed to a method for manufacturing the above-described self-fluxing pellets.

As material for forming the self-fluxing pellets 1, at least either dolomite or limestone having a particle size of 44 μm–1 mm (including artificial particles of this size prepared from at least either fine dolomite or limestone) is added to powdery iron ore (including slag and auxiliary material), and formed into green pellets by means of a pelletizer. Then, the green pellets are sintered at a temperature of 1220° C.–1300° C. to make the value of $CaO/SiO_2$ greater than 0.8. In this instance, the dolomite and limestone are preferred to contain particles of the sizes of 44 μm–1 mm in a proportion greater than 90%.

In this case, the proportion of the particles of 44 μm–1 mm in the pellet material is preferred to be greater than 90% for the following reasons. If smaller than 44 μm, it becomes difficult to secure the desired reducibility due to drops in the porosity ($cm^3/g$) and pore diameter of the self-fluxing pellets. On the other hand, if greater than 1 mm, the slag layer is hardly formed, giving rise to a problem in physical property, namely, a difficulty of obtaining sufficient crushing strength.

Further, as defined hereinabove, the sintering temperature is restricted to the range of 1220° C.–1300° C. for the following reasons. Namely, a temperature below 1220° C. will result in insufficient sisntering which makes the formation of the slag layer difficult, and also in the drawback of insufficient crushing strength same as in the case mentioned above. If higher than 1300° C., the porosity will drop due to excess sintering, failing to achieve the intended reducibility.

It is known that reduction of the $SiO_2$ content in the self-fluxing pellets 1 leads to reduction of the molten liquid which is produced from low temperatures, and therefore to the improvement of the reducibility. In this case, the desired reducibility can be obtained by controlling the $SiO_2$ content (%) to the amount which satisfies the following equation.

$$SiO_2\,(\%) < 1.14 \cdot \left(\frac{CaO}{SiO_2}\right) + 1.65$$

Moreover, iron ore which is lower than 1000 $cm^2/g$ in Blaine specific surface area (by JIS measuring method) is contained in the iron ore for the pellet material in an amount greater than 25%, such that the Blaine specific surface area of the pellet material falls in the range of 1800–3800 $cm^2/g$. In this case, a large amount of iron ore with a Blaine specific surface area lower than 1000 $cm^2/g$ is contained to coarsen the iron ore to a certain degree, namely, to enhance the porosity of the self-fluxing pellets for improving the reducibility. The Blaine specific surface area of the pellet material needs to be 1800–3800 $cm^2/g$ to develop the strength which is necessary for the pellet production and for use in blast furnaces.

Described below is a first specific embodiment more particularly depicting the self-fluxing pellets 1 and a method for producing same.

The pellet material was prepared by adding dolomite, containing particles in the grain size range of Table 1 below in a proportion greater than 90%, to powdery iron ores, and formed into green pellets, followed by sintering at each of the temperatures of 1250° C. and 1275° C. to obtain self-fluxing pellets 1.

Shown at (a) to (e) of FIG. 2 are photographs of the sections of the self-fluxing pellets 1 sintered at 1250° C., and at (a) to (e) of FIG. 3 are photographs of the sections of the self-fluxing pellets 1 sintered at 1275° C. These photographs are of an enlarged scale of ×3, showing specimens of various particle sizes in the range indicated in Table 1.

TABLE 1

Figure 2A:
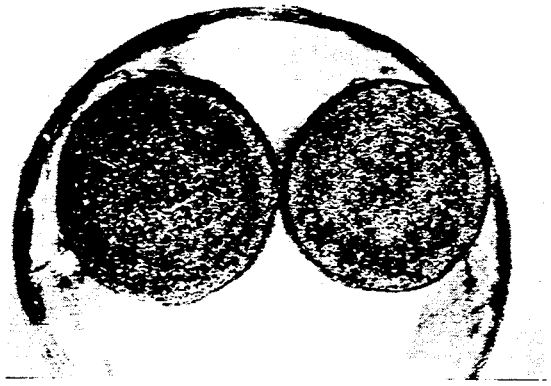
Figure 2B:
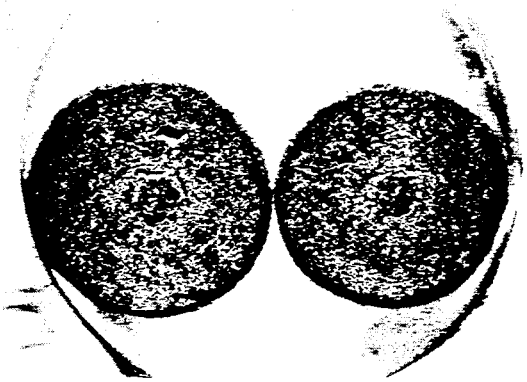
Figure 2C:
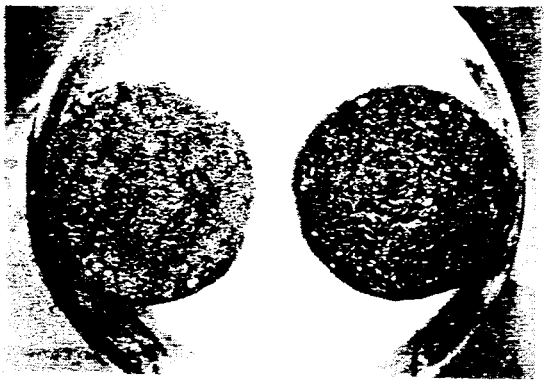
Figure 2D:
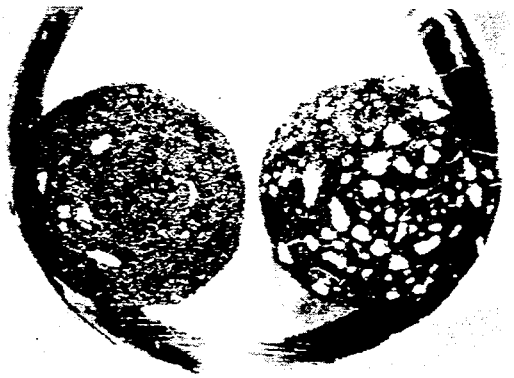
Figure 2E:
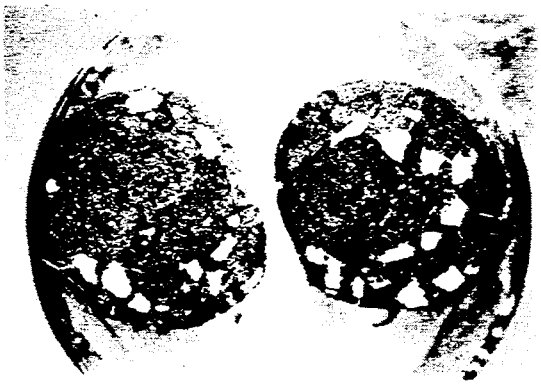
Figure 3A:
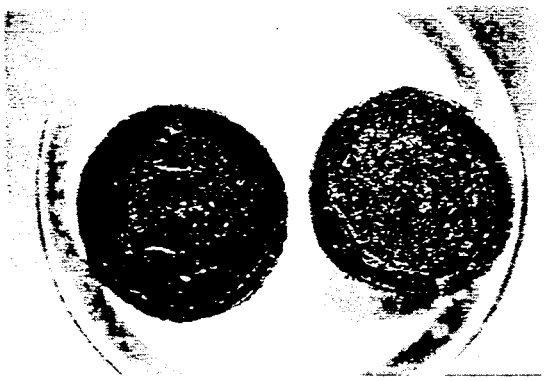
Figure 3B:
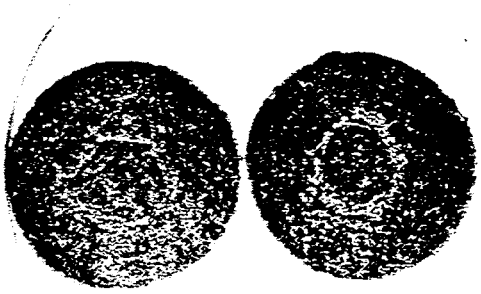
Figure 3C:
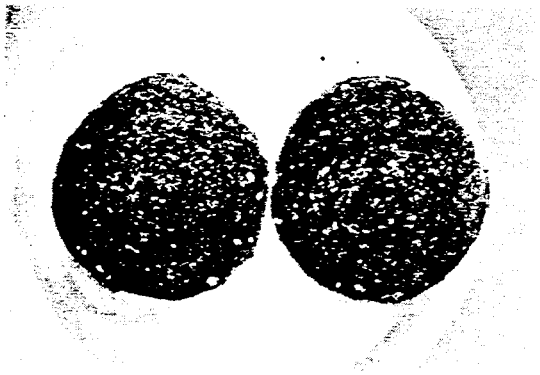
Figure 3D:
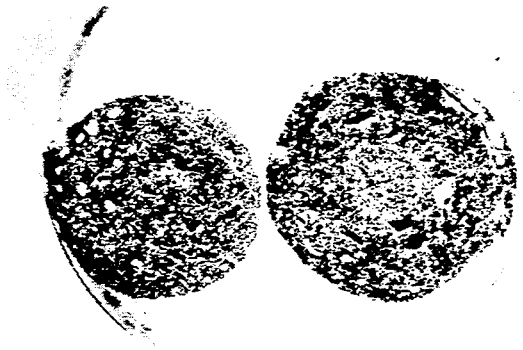
Figure 3E:
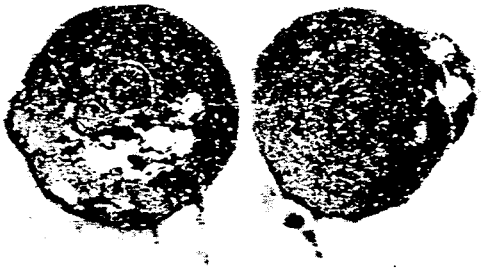

| Particle Size Range (mm) | Sintering Temperature 1250° C. | 1270° C. |
|---|---|---|
| ≦0.044 | FIG. 2(a) | FIG. 3(a) |
| 0.044–0.1 | FIG. 2(b) | FIG. 3(b) |
| 0.1–0.5 | FIG. 2(c) | FIG. 3(c) |
| 0.5–1.0 | FIG. 2(d) | FIG. 3(d) |
| 1.0–1.5 | FIG. 2(e) | FIG. 3(e) |

As seen from these figures, the amount of the pores 2 is increased as the particle size of dolomite becomes coarse.

Figure 4:
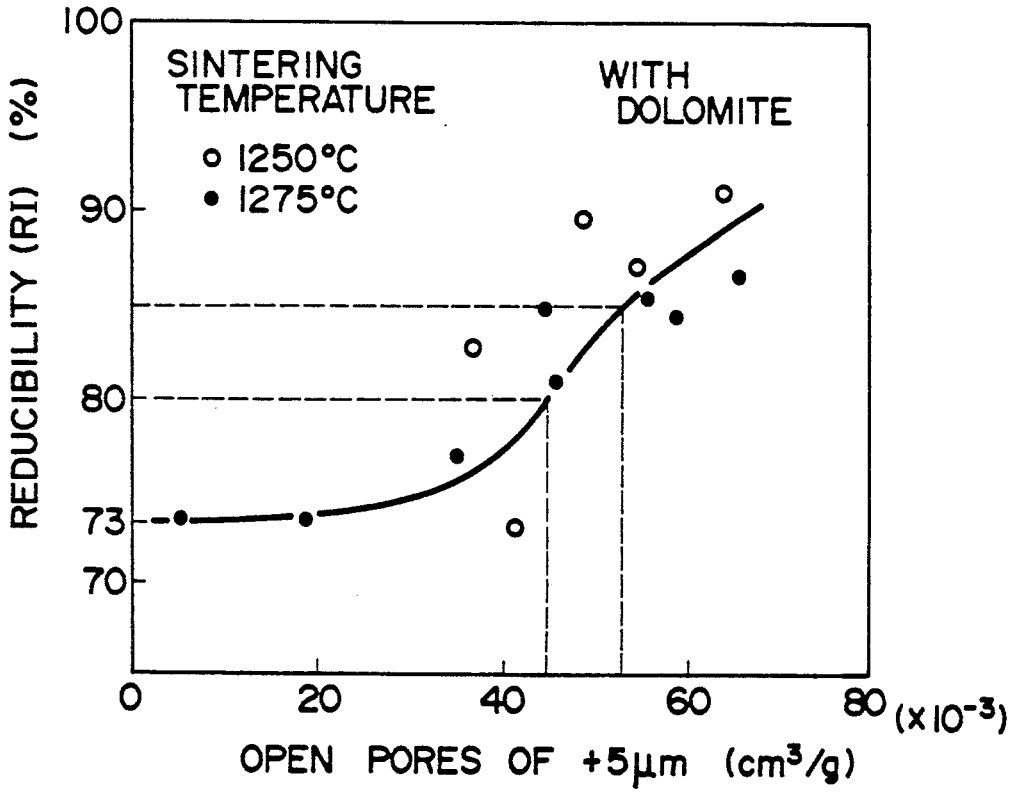

FIG. 4 shows the relationship between the amount of the open pores 2*a* and the reducibility RI of the self-fluxing pellets thus obtained. As will be understood therefrom that, when the open pores 2*a* with a diameter greater than 5 μm exist in a amount larger than 0.045 $cm^3/g$, it becomes possible to improve the reducibility to a marked degree beyond the maximum level (80%) of the conventional reducibility.

Figure 6:
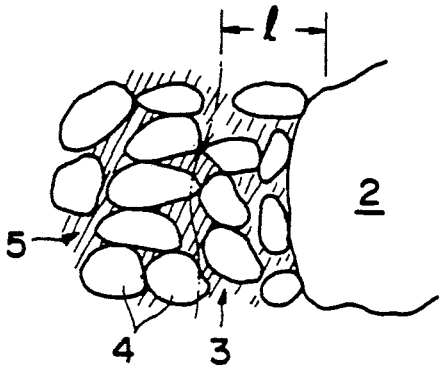
Figure 5:
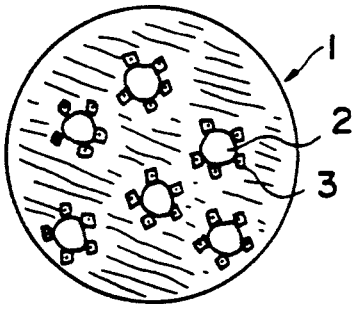

The self-fluxing pellets thus formed have a sectional shape as shown in FIG. 5 and in FIG. 6 which is a fragmentary view on an enlarged scale of the pellet in FIG. 5. As seen in FIG. 6, calcium ferrite-base vein stone phase 3 with a thickness l greater than 100 μm exists around the pores 2. Indicated at 4 is $Fe_2O_3$ and at 5 is a slag of low basicity.

Table 2 below shows compositions by weight of the vein stone phase 3 and the slag portion 5 of the pellets sintered at 1250° C., shown in FIGS. 5 and 6, along with the values of $CaO/SiO_2$ of the respective portions.

TABLE 2

| Reference numeral | (Sintered at 1250° C.) $Fe_2O_3$ | $SiO_2$ | CaO | MgO | Basicity |
|---|---|---|---|---|---|
| 3 | 56.0 | 11.7 | 20.2 | 2.4 | 1.73 |
| 5 | 20.4 | 32.4 | 32.4 | 2.1 | 1.0 |

Table 3 below shows the composition when sintered at 1270° C.

TABLE 3

| Reference numeral | (Sintered at 1270° C.) $Fe_2O_3$ | $SiO_2$ | CaO | MgO | Basicity |
|---|---|---|---|---|---|
| 3 | 78.1 | 5.7 | 12.9 | 2.6 | 2.26 |
| 5 | 16.9 | 30.1 | 38.2 | 1.3 | 1.27 |

Figure 7:
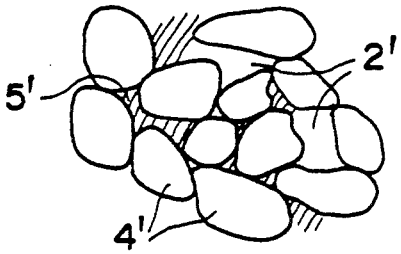

Shown in FIG. 7 is a view similar to FIG. 6 but showing a conventional counterpart having fine powder of dolomite added to the pellet material. In this case, there exists no vein stone phase 3 around pores 2'. Table 4 below shows the composition of the portion indicated at 5' in FIG. 7 and its basicity in relation with sintering temperatures.

TABLE 4

| Temp. (°C.) | Reference N. | $Fe_2O_3$ | $SiO_2$ | CaO | MgO | Basicity |
|---|---|---|---|---|---|---|
| 1250 | 5' | 46.4 | 15.6 | 20.3 | 3.0 | 1.30 |
| 1275 | 5' | 13.5 | 35.8 | 36.0 | 1.1 | 1.01 |

Upon comparing the foregoing Tables 2 to 4, it will be understood that $CaO/SiO_2$ is increased in the vicinity of the pores 2 in the Examples as compared with the conventional counterpart, thus achieving the improvement in reducibility.

Figure 8:
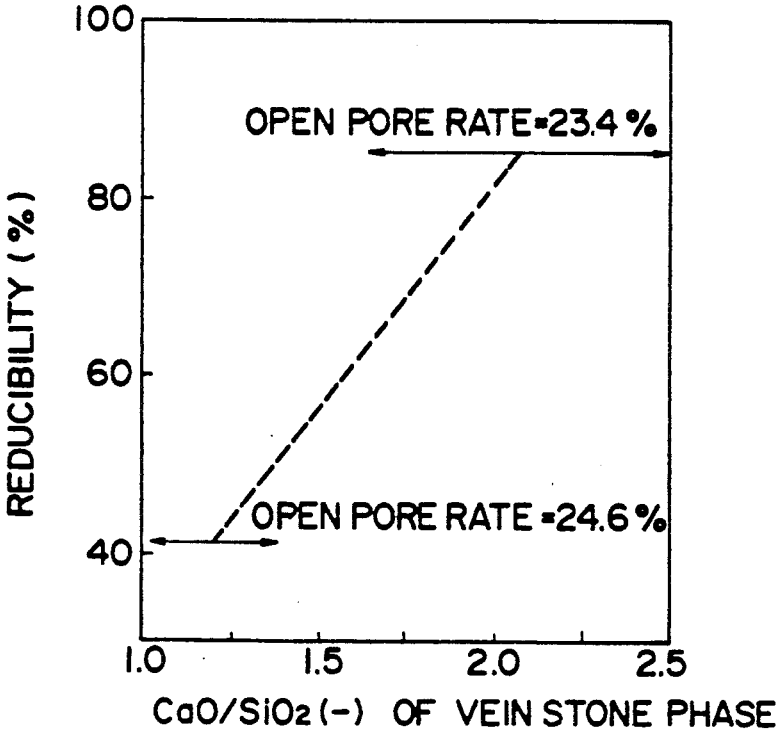
Figure 9:
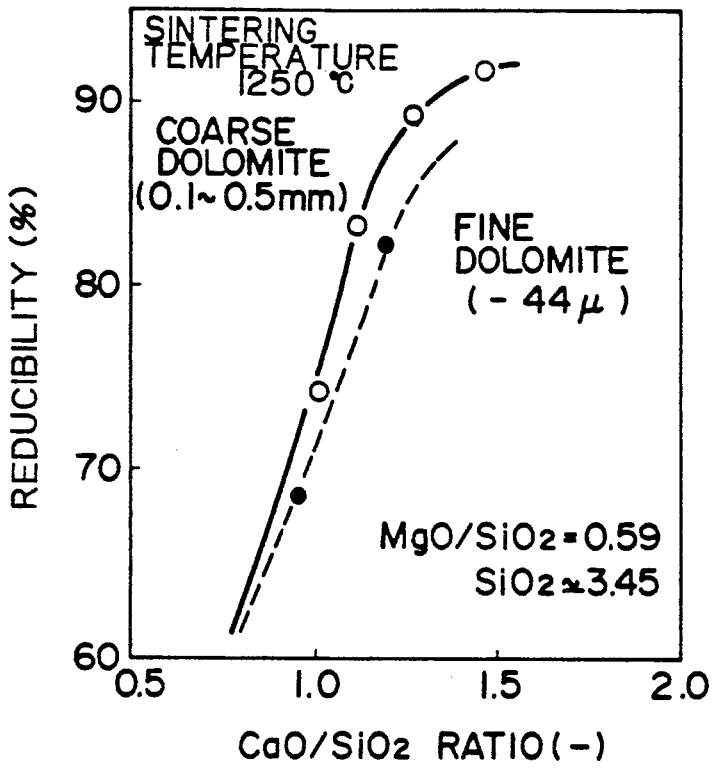

Referring to FIGS. 8 and 9, there are shown data of the self-fluxing pellets 1 sintered at 1250° C. FIG. 8 is a diagram of the reducibility versus the value of $CaO/SiO_2$ in the vein stone phase 3 of the self-fluxing pellets 1. The value of the reducibility against the value of $CaO/SiO_2$ varies depending upon the latter even with similar open pore rates of the self-fluxing pellets 1. As the structure of the vein stone phase 3 is not even, the value of $CaO/SiO_2$ extends over a certain range. Therefore, in order to secure high reducibility, it is appropriate to hold this value above 1.4.

FIG. 9 is a diagram showing the relationship between the reducibility and $CaO/SiO_2$ for the self-fluxing pellets 1 as a whole, along with a conventional counterpart (indicated by chain line) having fine powder of dolomite, smaller than 44 μm in particle size, added to the pellet material. As seen therefrom, the reducibility can be enhanced by using coarse dolomite with a particle size of 0.1–0.5 mm. It will also been seen that the reducibility is improved at each level of $CaO/SiO_2$ provided its value is greater than 0.8.

Figure 10:
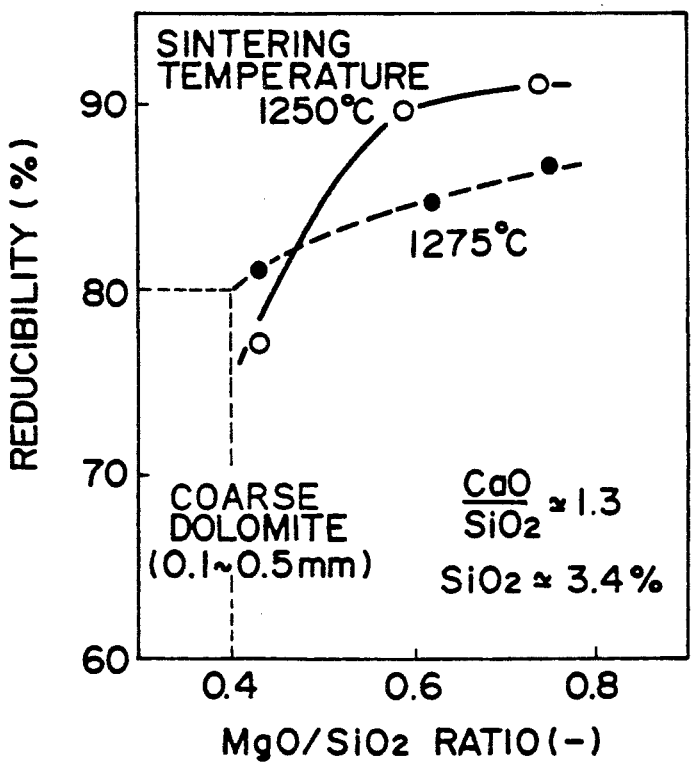

FIG. 10 is a diagram showing the relationship between the value of $MgO/SiO_2$ and the reducibility, for self-fluxing pellets 1 using as starting material coarse dolomite of a grain size of 0.1 mm–0.5 mm and sintered at 1250° C. and 1275° C. As will be understood therefrom, it is necessary to add MgO in an amount which makes the value of $MgO/SiO_2$ greater than 0.40, in order to secure high reducibility which excels the reducibility of 80%, the highest value currently available pellets of industrical products.

Described below is a second specific embodiment of the invention, more particularly illustrating the self-fluxing pellets and a method for producing same.

Limestone containing particles of the grain size range of Table 5 in a proportion greater than 90% was added to the pellet material, and formed into green pellets, followed by sintering at 1250° C. and 1275° C., respectively, to obtain self-fluxing pellets 1.

FIG. 11 shows at (a) to (e) photographs of sectioned self-fluxing pellets 1 sintered at 1250° C., while FIG. 12 shows at (a) to (e) photographs of sectioned self-fluxing pellets 1 sintered at 1275° C. These photographs show the pellets in the particle size range of Table 5 on an enlarged scale of ×3.

TABLE 5

Figure 11A:
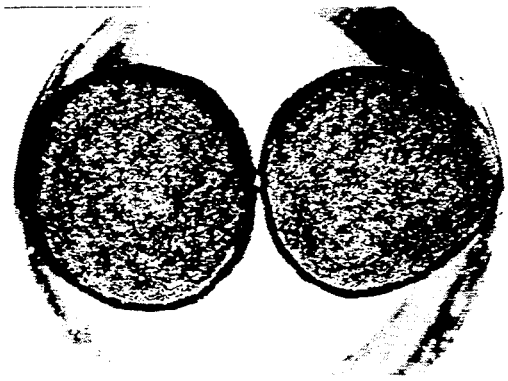
Figure 11B:
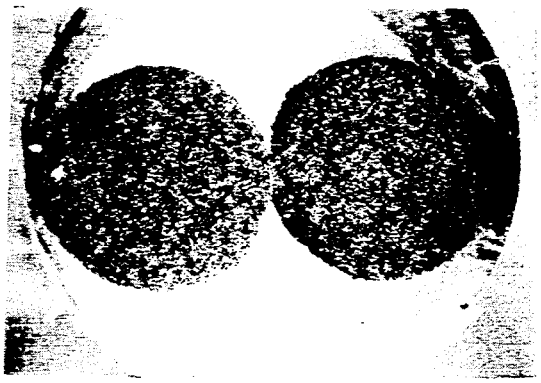
Figure 11C:
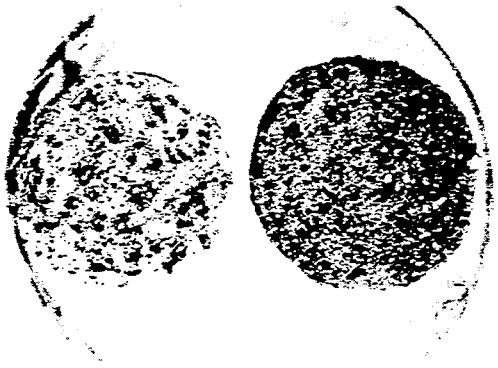
Figure 11D:
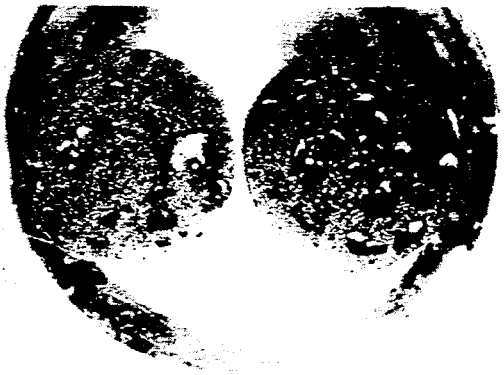
Figure 11E:
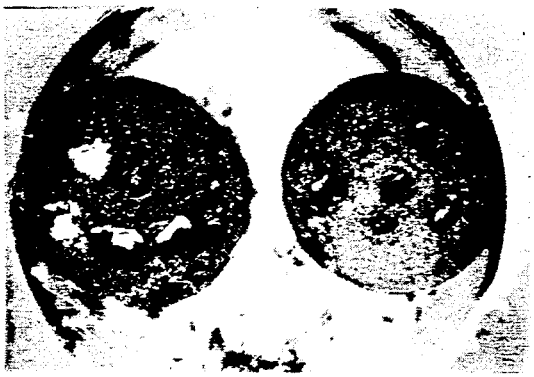
Figure 12A:
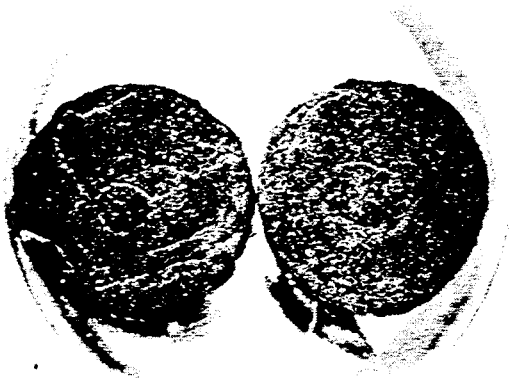
Figure 12B:
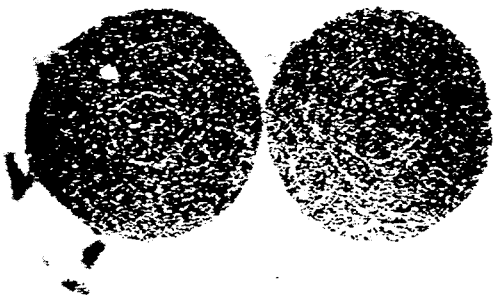
Figure 12C:
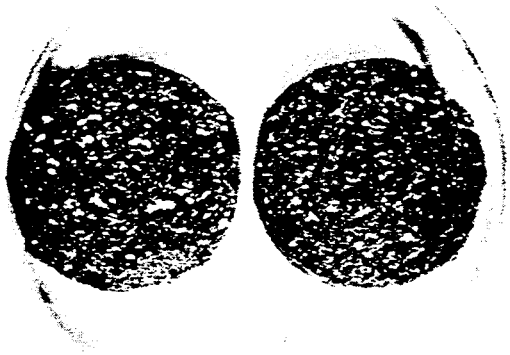
Figure 12D:
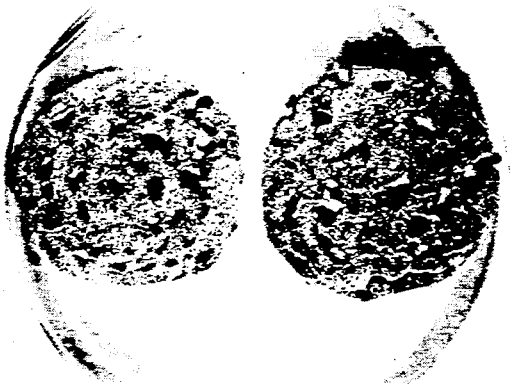
Figure 12E:
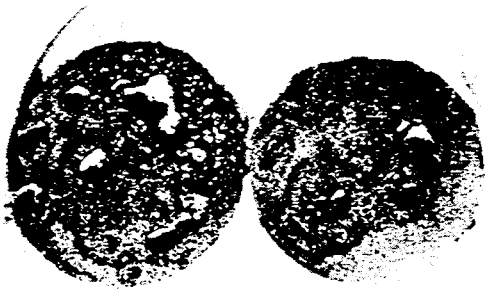

| Grain Size Range (mm) | Sintering Temperature 1250° C. | 1275° C. |
|---|---|---|
| ≦0.044 | FIG. 11(a) | FIG. 12(a) |
| 0.044–0.1 | FIG. 11(b) | FIG. 12(b) |
| 0.1–0.5 | FIG. 11(c) | FIG. 12(c) |
| 0.5–1.0 | FIG. 11(d) | FIG. 12(d) |
| 1.0–1.5 | FIG. 11(e) | FIG. 12(e) |

As seen in these figures, the amount of the pores 2 increases as the particle size of limestone is coarsened.

Figure 13:
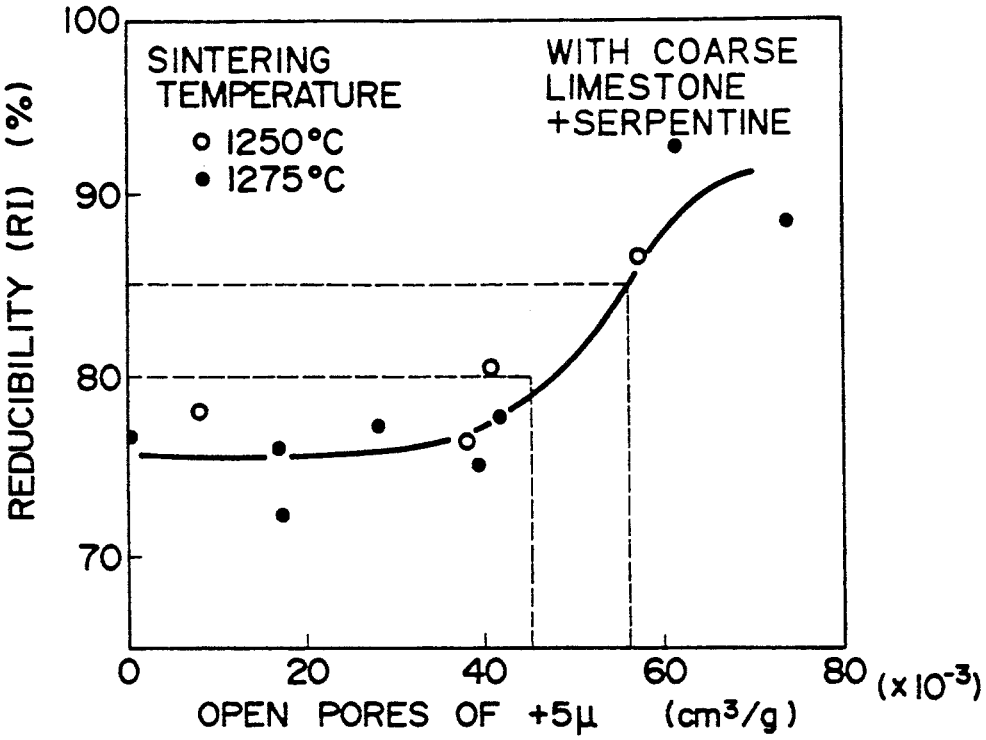

The diagram of FIG. 13 shows the relationship between the amount of the open pore 2a and the reducibility of the thus-formed self-fluxing pellets 1. It will be understood from this figure that, when the open pores 2a larger than 5 μm in diameter exist in an amount greater than 0.045 $cm^3/g$, the reducibility is improved markedly above 80% which has been the maximum level of the conventional reducibility.

Figure 15:
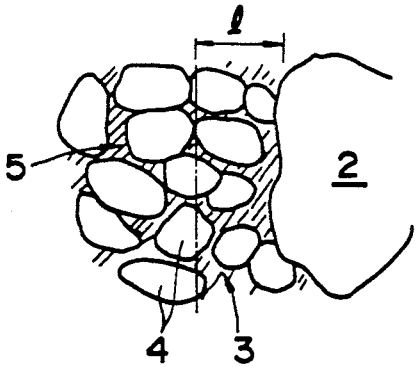
Figure 14:
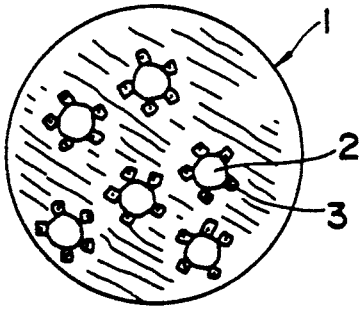

The self-fluxing pellets 1 formed in the above-described manner have sectional shapes as shown in FIG. 14 and as shown fragmentarily on an enlarged scale in FIG. 15. As seen in FIG. 15, vein stone phase of 150–400 μm in thickness l exists around pores 2. The reference numeral 4 denotes $Fe_2O_3$.

Table 6 below shows the compositions by weight of the vein stone phase 3 and the portion indicated by the reference numeral 5, in the self-fluxing pellets sintered at 1250° C.

TABLE 6

| Reference N. | (Sintered at 1250° C.) $Fe_2O_3$ | $SiO_2$ | CaO | MgO | Basicity |
|---|---|---|---|---|---|
| 3 | 76.4 | 4.4 | 17.8 | 0.7 | 4.05 |
| 5 | 23.6 | 39.3 | 24.2 | 10.5 | 0.61 |

Table 7 below shows the compositions of the similar portions in the self-fluxing pellets sintered at 1275° C.

TABLE 7

| Reference N. | (Sintered at 1275° C.) $Fe_2O_3$ | $SiO_2$ | CaO | MgO | Basicity |
|---|---|---|---|---|---|
| 3 | 85.0 | 1.8 | 10.4 | 2.3 | 5.8 |
| 5 | 15.4 | 36.6 | 34.6 | 1.8 | 0.95 |

Figure 16:
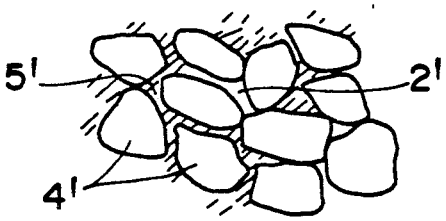

Illustrated in FIG. 16 is a conventional counterpart with fine powder of limestone added to the pellet material, showing the part corresponding to FIG. 15. In this case, no vein stone phase 3 exists around the pores 2'. Table 8 below shows the composition of the part corresponding to 5' in FIG. 12 along with its basicity, in relation with the respective sintering temperatures.

TABLE 8

| Temp. °C. | Ref. Nr. | $Fe_2O_3$ | $SiO_2$ | CaO | MgO | Basicity |
|---|---|---|---|---|---|---|
| 1250 | 5' | 62.8 | 10.5 | 16.3 | 4.1 | 1.55 |
| 1275 | 5' | 34.7 | 21.8 | 32.9 | 3.1 | 1.51 |

Upon comparing Tables 6 and 7 with Table 8, it will be understood that the value of $CaO/SiO_2$ of this embodiment is far higher than the conventional pellets, as a result improving reducibility similarly to the above-described first specific embodiment.

What is claimed is:

1. A self-fluxing pellet suitable for charging into a blast furnace and having a reducibility of greater than about 80%, comprising:

(a) open pores larger than about 5 μm in diameter and being present in said pellet in an amount of greater than about 0.045 $cm^3/g$; and (b) calcium.ferrite structures being present around pores larger than about 5 μm in diameter including said open pores, said calcium.ferrite structures having a thickness larger than about 100 μm and having a $CaO/SiO_2$ ratio of greater than about 1.4;

said pellet having a $CaO/SiO_2$ ratio of greater than about 0.8 as a whole.

2. The self-fluxing pellet defined in claim 1, further having a $MgO/SiO_2$ ratio as a whole of greater than about 0.40.

3. A method for producing a self-fluxing pellet, comprising:

(a) adding as a pellet material at least one of coarse dolomite and limestone greater than 90% of which has a particle size of about 44 μm–1 mm to powdery iron ore;

(b) forming the resulting mixture into green pellets; and (c) sintering said green pellets at a temperature of about 1220° C.–1300° C. to attain a $CaO/SiO_2$ ratio of greater than about 0.8.

4. The method defined in claim 3, wherein said green pellets are sintered to have, after sintering, a $MgO/SiO_2$ ratio of greater than about 0.40.

5. The method defined in claim 3, wherein said green pellets are sintered to have, after sintering, a $SiO_2$ content satisfying the following condition.

$$SiO_2\,(\%) < 1.14 \cdot \left(\frac{CaO}{SiO_2}\right) + 1.65$$

6. The method defined in claim 4, wherein said green pellets are sintered to have, after sintering, a $SiO_2$ content satisfying the following condition.

$$SiO_2\,(\%) < 1.14 \cdot \left(\frac{CaO}{SiO_2}\right) + 1.65$$

7. The method defined in claim 4, wherein iron ore having a Blaine specific surface area smaller than about 1000 $cm^2/g$ is contained in said pellet material in an amount of greater than about 25% to make the Blaine specific surface area of said pellet material about 1800–3800 $cm^2/g$.

8. The self-fluxing pellet defined in claim 1, wherein said calcium.ferrite structures around said pores have a thickness of about 150–400 μm.

9. The method defined in claim 3, wherein coarse dolomite is used having a particle size of 0.1–0.5 mm.

10. The self-fluxing pellet defined in claim 1, wherein said $MgO/SiO_2$ ratio as a whole is greater than about 0.47.

* * * * *

UNITED STATES PATENT AND TRADEMARK OFFICE

CERTIFICATE OF CORRECTION

PATENT NO. : 5,127,940

DATED : July 7, 1992

INVENTOR(S) : Takeshi Sugiyama et al.

It is certified that error appears in the above-identified patent and that said Letters Patent is hereby corrected as shown below:

On the Title page, item [30], Priority Data should read as follows:

--Nov. 20, 1987 [JP] Japan.....62-294574

Nov. 20, 1987 [JP] Japan.....62-294575--.

Signed and Sealed this

Twenty-first Day of September, 1993

Bruce Lehman

*Attest:*

BRUCE LEHMAN

*Attesting Officer*

*Commissioner of Patents and Trademarks*